US008704451B2

(12) United States Patent
Lu

(10) Patent No.: US 8,704,451 B2
(45) Date of Patent: Apr. 22, 2014

(54) DRIVING CIRCUIT OF LIGHT EMITTING DIODE

(75) Inventor: Yung-Chen Lu, Hsinchu County (TW)

(73) Assignee: Excelliance MOS Corporation, Hsinchu County (TW)

( * ) Notice: Subject to any disclaimer, the term of this patent is extended or adjusted under 35 U.S.C. 154(b) by 230 days.

(21) Appl. No.: 13/267,914

(22) Filed: Oct. 7, 2011

(65) Prior Publication Data

US 2013/0088161 A1 Apr. 11, 2013

(51) Int. Cl.
*H05B 37/02* (2006.01)

(52) U.S. Cl.
USPC ..... 315/200 R; 323/285; 363/143; 315/203; 315/272

(58) Field of Classification Search
USPC ..... 315/200 R; 363/285
See application file for complete search history.

(56) References Cited

U.S. PATENT DOCUMENTS

| | | | | |
|---|---|---|---|---|
| 7,750,616 | B2 | 7/2010 | Liu | |
| 2008/0316781 | A1* | 12/2008 | Liu | 363/80 |
| 2010/0207536 | A1* | 8/2010 | Burdalski et al. | 315/224 |
| 2011/0140616 | A1* | 6/2011 | Yan et al. | 315/186 |
| 2011/0193488 | A1 | 8/2011 | Kanamori et al. | |
| 2012/0229044 | A1* | 9/2012 | Nerone | 315/210 |
| 2012/0280630 | A1* | 11/2012 | Lu | 315/188 |
| 2013/0069546 | A1* | 3/2013 | Lin et al. | 315/186 |

FOREIGN PATENT DOCUMENTS

| | | |
|---|---|---|
| DE | 102010043699 | 1/2012 |
| JP | 2012-069506 | 4/2012 |

OTHER PUBLICATIONS

"Office Action of Germany counterpart application" issued on Jul. 24, 2012, p. 1-p. 11.

* cited by examiner

*Primary Examiner* — Douglas W Owens
*Assistant Examiner* — Monica C King
(74) *Attorney, Agent, or Firm* — Jianq Chyun IP Office

(57) ABSTRACT

A driving circuit of a light emitting diode (LED) including an AC power, a rectifier, a power converter, a waveform sampler, and a control circuit is provided. The AC power provides an AC signal. The rectifier is coupled to the AC power and outputs a driving signal. The power converter is coupled to the rectifier. The power converter includes an LED and outputs a first signal positive correlated with a current passing through the LED. The waveform sampler is coupled between the AC power and the rectifier, and outputs a second signal directly proportional to the AC signal. The control circuit is coupled between the waveform sampler and the power converter, and outputs a control signal to the power converter according to a comparison result between the first signal and the second signal.

12 Claims, 8 Drawing Sheets

DRIVING CIRCUIT OF LIGHT EMITTING DIODE

BACKGROUND OF THE INVENTION

1. Field of the Invention

The invention relates to a driving circuit. Particularly, the invention relates to a driving circuit of a light emitting diode (LED).

2. Description of Related Art

Since a light emitting diode (LED) has a small volume and low power consumption, products using the LEDs as light sources become popular as processing techniques gradually become mature. Since a tiny change of bias may cause a significant change of an operating current within an operation range of the LED, the LED has to be driven by a fixed current; otherwise, once the current exceeds a rated value, the LED is probably damaged.

FIG. 1 is a schematic diagram of a conventional driving circuit of LED. Referring to FIG. 1, the driving circuit 100 includes an alternating current (AC) voltage source 101, a bridge rectifier 102, and a buck converter 110. The AC voltage source 101 drives a LED 103 through the bridge rectifier 102, where the LED 103, an inductor 104 and a diode 105 are coupled in a loop. A clock generator 106 provides a clock signal to a setting terminal S of a SR flip-flop 108 to trigger the setting terminal S of the SR flip-flop 108 for each clock pulse, so as to turn on a switch Qm. When the switch Qm is turned on, a current flowing through the LED 103 and the inductor 104 is gradually increased. Now, the diode 105 is inversely biased and is not conducted. Therefore, a current Isw flowing through a resistor Rsen is equivalent to the current flowing through the LED 103. When the current of the LED 103 is increased to cause a cross-voltage of the resistor Rsen to be greater than a reference voltage Vref (for example, 0.5V), a comparator 107 triggers a reset terminal R of the SR flip-flop 108 to turn off the switch Qm. When the switch Qm is turned off, the current of the LED 103 is cycled in the loop formed by the LED 103, the inductor 104 and the diode 105, and the current is gradually decreased along with energy dissipation of the LED 103 until a next clock pulse is generated. Therefore, the current of the LED 103 presents a periodic sawtooth waveform, and approximately has a stable value.

On the other hand, in order to ensure continuity of the current of the LED 103, a large capacitor Cin (which is, for example, 47 μF) is generally coupled between the bridge rectifier 102 and the buck converter 110. The capacitor Cin is used to maintain an input direct current (DC) voltage Vcin, so that the DC voltage Vcin is maintained to be higher than a conducting voltage Vf of the LED 103. However, the excessively large capacitor Cin may lead to a narrow conducting phase angle and a poor input power factor.

In order to increase the power factor of the conventional driving circuit of the LED, one method is to use a power factor correction (PFC) front-stage circuit. Referring to FIG. 2, a driving circuit 100' of the LED of FIG. 2 includes a boost PFC control circuit 120 for increasing the power factor. However, as shown in FIG. 2, although the driving circuit of FIG. 2 has a higher power factor, it is more complicated and occupies more space compared to the driving circuit of FIG. 1. Moreover, in many small-scale LED lighting devices, there is not space to accommodate the additional circuit device of FIG. 2.

SUMMARY OF THE INVENTION

Accordingly, the invention is directed to a driving circuit of a light emitting diode (LED), which has a good power factor.

The invention provides a driving circuit of a light emitting diode (LED), which includes an alternating current (AC) power, a rectifier, a power converter, a waveform sampler and a control circuit. The AC power has a first end and a second end, and provides an AC signal through the first end and the second end. The rectifier has a third end, a fourth end and a fifth end. The third end and the fourth end are respectively coupled to the first end and the second end, and the rectifier outputs a driving signal through the fifth end. The power converter has a sixth end, and the sixth end is coupled to the fifth end. The power converter includes an LED, and outputs a first signal positive correlated with a current passing through the LED through a seventh end. The waveform sampler has an eighth end and a ninth end. The eighth end is coupled between the AC power and the rectifier, and the waveform sampler outputs a second signal directly proportional to the AC signal through the ninth end. The control circuit has a tenth end, and is coupled between the ninth end of the waveform sampler and the seventh end of the power converter, and outputs a control signal to the power converter through the tenth end.

In an embodiment of the invention, the waveform sampler includes a first resistor and a second resistor. One end of the first resistor is coupled to the AC power, and another end thereof is coupled to the ninth end of the waveform sampler. One end of the second resistor is coupled to the first resistor and the ninth end of the waveform sampler, and another end thereof is coupled to ground.

In an embodiment of the invention, the driving circuit of the LED further includes a third resistor and a fourth resistor. One end of the third resistor is coupled to the first end of the AC power, and another end thereof is coupled to the first resistor. One end of the fourth resistor is coupled to the third resistor, and another end thereof is coupled to the second end of the AC power.

In an embodiment of the invention, the driving circuit of the LED further includes a capacitor coupled between the fifth end of the rectifier and ground.

In an embodiment of the invention, the power converter further includes a switch and a current sensor. The switch is coupled to the LED. The current sensor is coupled to the switch and ground, and the current sensor outputs the first signal through the seventh end.

In an embodiment of the invention, the first signal is a voltage signal.

In an embodiment of the invention, the current sensor includes a fifth resistor. The fifth resistor is coupled to the LED in series.

In an embodiment of the invention, the power converter is a buck converter.

In an embodiment of the invention, the power converter is a fly back converter.

In an embodiment of the invention, the power converter is a forward converter.

In an embodiment of the invention, the control circuit includes a clock generator, a SR flip-flop and a comparator. The SR flip-flop is coupled between the clock generator and the power converter, and includes a setting terminal and a reset terminal, and receives a clock signal through the setting terminal. The comparator has a positive end, a negative end and an output end. The positive end is coupled to the seventh end of the power converter, the negative end is coupled to the ninth end of the waveform sampler, and the output end is coupled to the reset terminal of the SR flip-flop.

In an embodiment of the invention, the rectifier is a bridge rectifier.

According to the above descriptions, in the invention, by directly coupling the waveform sampler to the AC power to capture the second signal, the captured second signal is very close to the AC signal and is less influenced by post-end load devices, so that a higher power factor can be provided.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

First Embodiment

Figure 3:
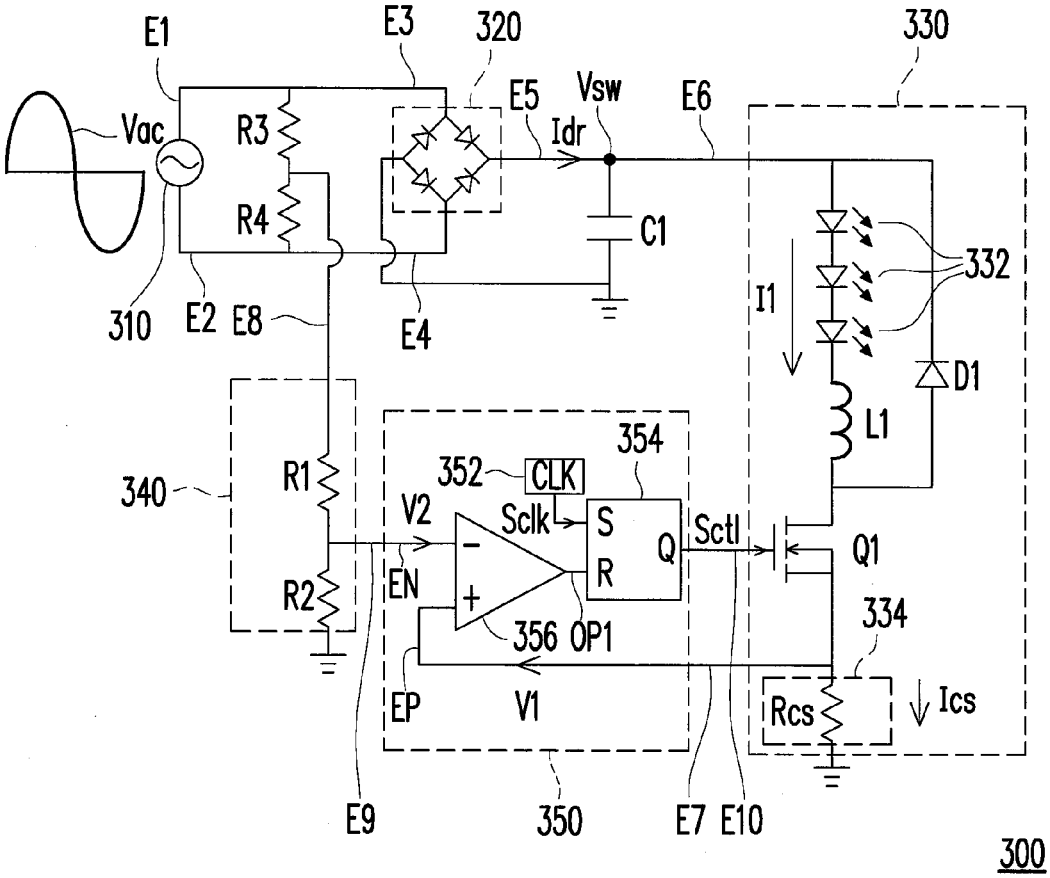
FIG. 3 is a schematic diagram of a driving circuit of LED according to the first embodiment of the invention.

FIG. 3 is a schematic diagram of a driving circuit of light emitting diode (LED) according to the first embodiment of the invention. Referring to FIG. 3, the driving circuit 300 of LED includes an alternating current (AC) power 310, a rectifier 320, a power converter 330, a waveform sampler 340 and a control circuit 350. The AC power 310 has a first end E1 and a second end E2, and provides an AC signal Vac through the first end E1 and the second end E2 for driving the LED, where the AC signal Vac of the present embodiment is, for example, an AC voltage.

As shown in FIG. 3, the rectifier 320 is, for example, a bridge rectifier. In detail, the rectifier 320 has a third end E3, a fourth end E4 and a fifth end E5, where the third end E3 and the fourth end E4 are respectively coupled to the first end E1 and the second end E2 of the AC power 310. Moreover, the rectifier 320 outputs a driving signal Idr through the fifth end E5, where the driving signal Idr is, for example, a driving current. Moreover, a most outstanding feature of the embodiment is to directly use the AC signal Vac for signal control, and a value of a capacitor C1 of the driving circuit 300 can be very small (which is about 0.1 μF), where the capacitor C1 is used as a high-frequency filter capacitor. However, if a direct current (DC) power signal of the rectifier 320 is used for signal control, the value of the capacitor C1 of the driving circuit 300 is required to be about 1 μF to stabilize the DC power signal and avoid signal distortion due to a load effect, so as to avoid reduction of a power factor.

Referring to FIG. 3, the power converter 330 has a sixth end E6, and the sixth end E6 is coupled to the fifth end E5 of the rectifier 320. Moreover, the power converter 330 includes LEDs 332 (three LEDs are schematically illustrated), and outputs a signal V1 through a seventh end E7, where the signal V1 is positive correlated with a current I1 passing through the LEDs 332. Namely, the higher the current I1 flowing through the LEDs 332 is, the greater the signal V1 is, and in the present embodiment, the signal V1 is, for example, a voltage signal. Moreover, in the present embodiment, the power converter 330 is, for example, a buck converter. In detail, beside the LEDs 332, the power converter 330 further includes a diode D1, an inductor L1, a switch Q1 and a current sensor 334. The current sensor 334 is coupled to the switch Q1 and ground, and outputs the signal V1 through the seventh end E7. Moreover, the current sensor 334 includes a resistor Rcs, and the resistor Rcs is coupled to the LEDs 332 in series. A magnitude of the signal V1 is equivalent to a cross-voltage of the resistor Rcs. In other words, the resistor Rcs is adapted to convert the current I1 flowing through the LEDs 332 into a voltage signal (i.e. the signal V1), and provides the voltage signal V1 at an end (corresponding to the seventh end E7) of the resistor Rcs.

On the other hand, the waveform sampler 340 has an eighth end E8 and a ninth end E9. The eighth end E8 is coupled between the AC power 310 and the rectifier 320, and the waveform sampler 340 outputs a signal V2 directly proportional to the AC signal Vac through the ninth end E9. The signal V2 is, for example, a voltage signal, and is a divided voltage of the AC signal Vac. As shown in FIG. 3, the waveform sampler 340 includes a resistor R1 and a resistor R2. In detail, one end of the resistor R1 is coupled to the AC power 310, and another end of the resistor R1 is coupled to the ninth end E9 of the waveform sampler 340. One end of the resistor R2 is coupled to the resistor R1 and the ninth end E9 of the waveform sampler 340, and another end of the resistor R2 is coupled to the ground. On the other hand, the driving circuit 300 of LED further includes resistors R3 and R4. One end of the resistor R3 is coupled to the first end E1 of the AC power 310, and another end of the resistor R3 is coupled to the resistor R1. One end of the resistor R4 is coupled to the resistor R3, and another end of the resistor R4 is coupled to the second end E2 of the AC power 310. According to the above descriptions, the resistors R1-R4 form a voltage-dividing circuit, so that the signal V2 is directly proportional to the AC signal Vac output by the AC power 310. It should be noticed that since the waveform sampler 340 is directly coupled to the AC power 310 other than indirectly coupled to the AC power 310 through the rectifier 320, the voltage-divided signal V2 is less influenced by post-end devices (for example, the rectifier 320 or the capacitor C1 or other electronic devices), so that a waveform of the signal V2 can be very close to the waveform of the AC signal Vac.

Referring to FIG. 3, the control circuit 350 is coupled between the ninth end E9 of the waveform sampler 340 and the seventh end E7 of the power converter 330, and outputs a control signal Sct1 to the power converter 330 through a tenth end E10. The control circuit 350 is used to turn on/off the switch Q1 according to a comparison result of the signals V1 and V2, so as to activate or deactivate the buck power converter 330. In detail, the control circuit 350 outputs the control signal Sct1 to the power converter 330 through the tenth end E10, so as to activate or deactivate the power converter 330. As shown in FIG. 3, the control circuit 350 includes a clock generator 352, a SR flip-flop 354 and a comparator 356. The SR flip-flop 354 is coupled between the clock generator 352 and the power converter 330. The SR flip-flop 354 has a setting terminal S, a reset terminal R and an output terminal Q. The clock generator 352 is coupled to the setting terminal S of the SR flip-flop 354, and the SR flip-flop 354 receives a clock signal Sclk through the setting terminal S. The output terminal Q of the SR flip-flop 354 is coupled to the switch Q1, and the SR flip-flop 354 outputs the control signal Sct1 through the output terminal Q to activate or deactivate the power converter 330. The comparator 356 has a positive end EP, a negative end EN and an output end OP1. The positive end EP is coupled to the seventh end E7 of the power converter 330 for receiving the signal V1, the negative end EN is coupled to the ninth end E9 of the waveform sampler 340 for receiving the signal V2. The output end OP1 is coupled to the reset terminal R of the SR flip-flop 354. When a voltage level of the signal V1 is higher than a voltage level of the signal V2, the output terminal OP1 of the comparator 356 triggers the reset terminal R of the SR flip-flop 354.

In detail, the clock generator 354 outputs the clock signal Sclk to the setting terminal S of the SR flip-flop 354. When each clock pulse is generated, the setting terminal S is triggered to enable the output of the SR flip-flop 354 to turn on the switch Q1. When the switch Q1 is turned on, the current I1 of the LEDs 332 is equivalent to the current of the flowing through the switch Q1 and the current sensor 334, i.e. a current Ics. Now, the diode D1 is inversely biased and is not conducted. The current I1 flowing through the LEDs 332 and the inductor L1 is gradually increased as a voltage Vsw of the sixth end E6 increases until the signal V1 is higher than the signal V2, and then the output terminal OP1 of the comparator 356 triggers the reset terminal R of the SR flip-flop 354, and the output terminal Q of the SR flip-flop 354 outputs the control signal Sct1 to turn off the switch Q1. When the switch Q1 is turned off, the current Ics is decreased to zero. Now, the current I1 of the LEDs 332 flows in a loop formed by the LEDs 332, the inductor L1 and the diode D1, and the current I1 is gradually decreased along with energy dissipation of the LEDs 332 until a next clock pulse is generated by the clock generator 352.

Figure 1:
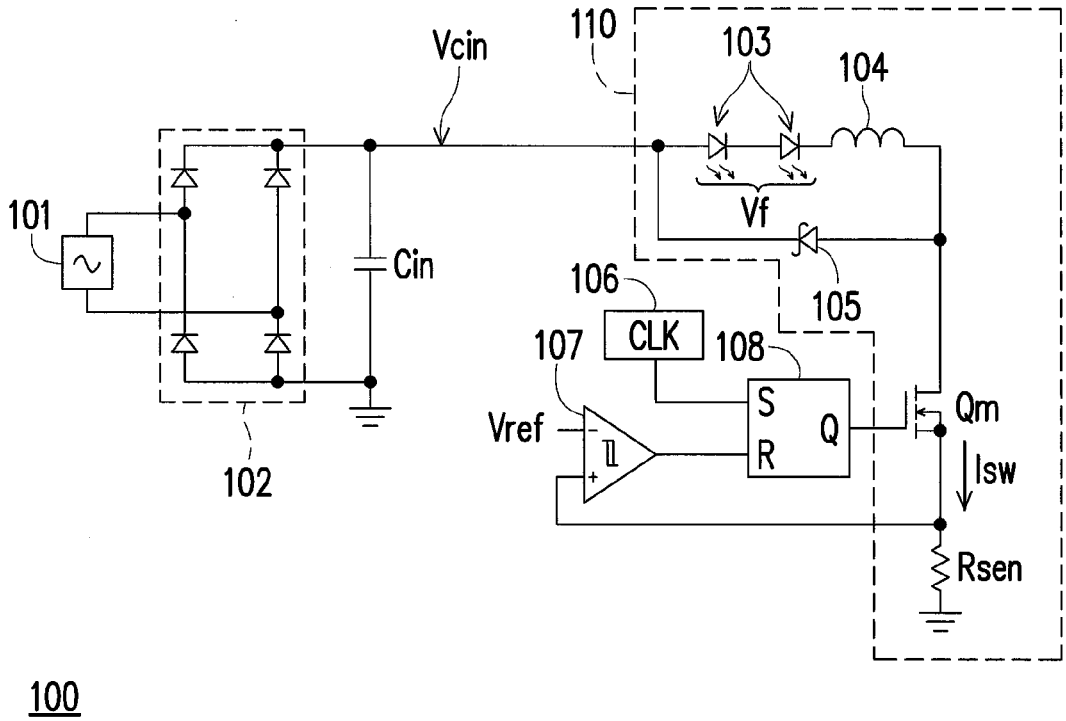
FIG. 1 (RELATED ART)
FIG. 1 is a schematic diagram of a conventional driving circuit of light emitting diode (LED).
Figure 2:
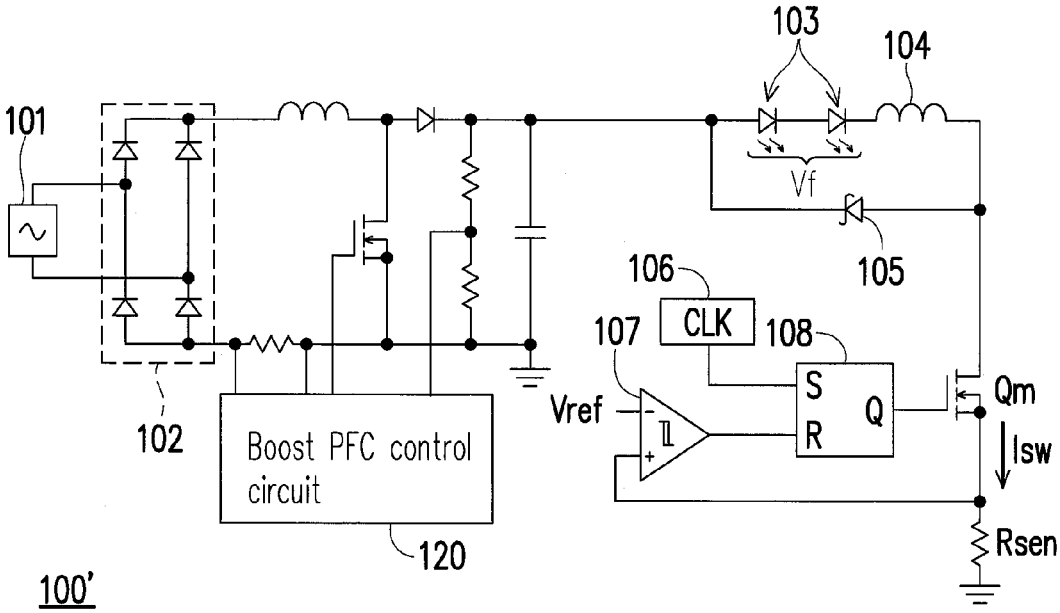
FIG. 2 (RELATED ART)
FIG. 2 is a schematic diagram of a conventional driving circuit of LED.
Figure 4A:
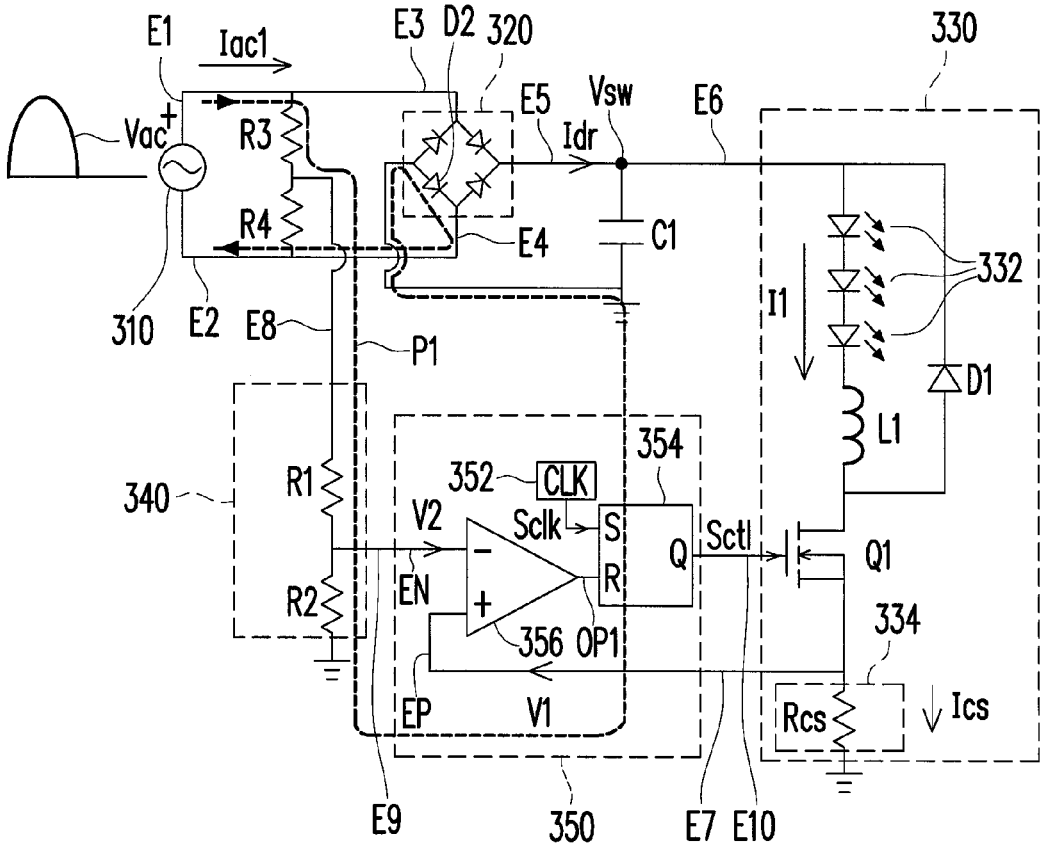
FIG. 4A is a schematic diagram illustrating a current path of the driving circuit of LED of FIG. 3 when an AC power provides a positive voltage.

FIG. 4A is a schematic diagram illustrating a current path of the driving circuit 300 of LED of FIG. 3 when the AC power 310 provides a positive voltage $Vac^+$. As shown in FIG. 4A, when the AC power 310 provides the positive voltage $Vac^+$, a path P1 of a part of the current Iac1 is sequentially the first end E1, the resistor R3, the waveform sampler 340, the ground terminal, the diode D2 and the second end E2. When the current Iac1 flows through the resistor R2 of the waveform sampler 340, the signal V2 corresponding to the positive voltage $Vac^+$ is generated at the negative end EN of the comparator 356, and the signal V2 is provided to the comparator 356 for comparison, so as to turn on or turn off the power converter 330. It should be noticed that since the waveform sampler 340 of the embodiment is directly coupled to the AC power 310 other than indirectly coupled to the AC power 310 through the rectifier 320 or the capacitor C1, i.e. the rectifier 320 and the capacitor C1 are not coupled between the waveform sampler 340 and the AC power 310, a magnitude of the current Iac1 is less influenced by other loads such as the capacitor C1 and the rectifier 320, etc., and the signal V2 output by the waveform sampler 340 is more close to the positive voltage $Vac^+$. Since the signal V2 to be captured is more close to a source (i.e. the positive voltage $Vac^+$), the current waveform of the current Ics is more close to a voltage waveform of the positive voltage $Vac^+$, and waveforms of the driving current Idr and the current Iac1 are more closed to the waveform of the positive voltage $Vac^+$, so as to achieve a higher power factor. On the other hand, compared to the conventional circuit of FIG. 1, since the comparator 107 of FIG. 1 receives the fixed reference voltage Vref, the current Isw of FIG. 1 cannot follow the waveform of the positive voltage $Vac^+$ to achieve a better power factor. In the present embodiment, since the waveform sampler 340 is directly coupled to the source, the signal V2 received by the comparator 356 can be varied along with the positive voltage $Vac^+$, and the current waveform of the current Ics is more close to the waveform of the positive voltage $Vac^+$, so that the waveform of the current Iac1 is more close to the waveform of the positive voltage $Vac^+$, so as to achieve a better power factor.

Figure 4B:
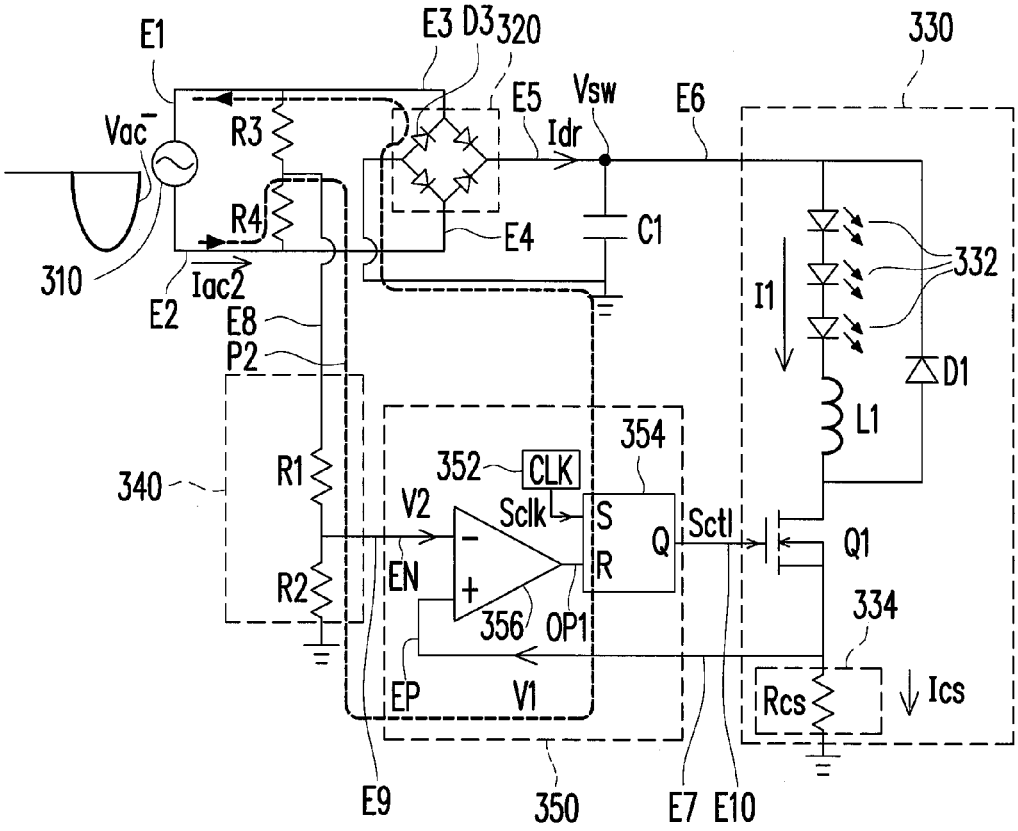
FIG. 4B is a schematic diagram illustrating a current path of the driving circuit of LED of FIG. 3 when an AC power provides a negative voltage.
Figure 5:
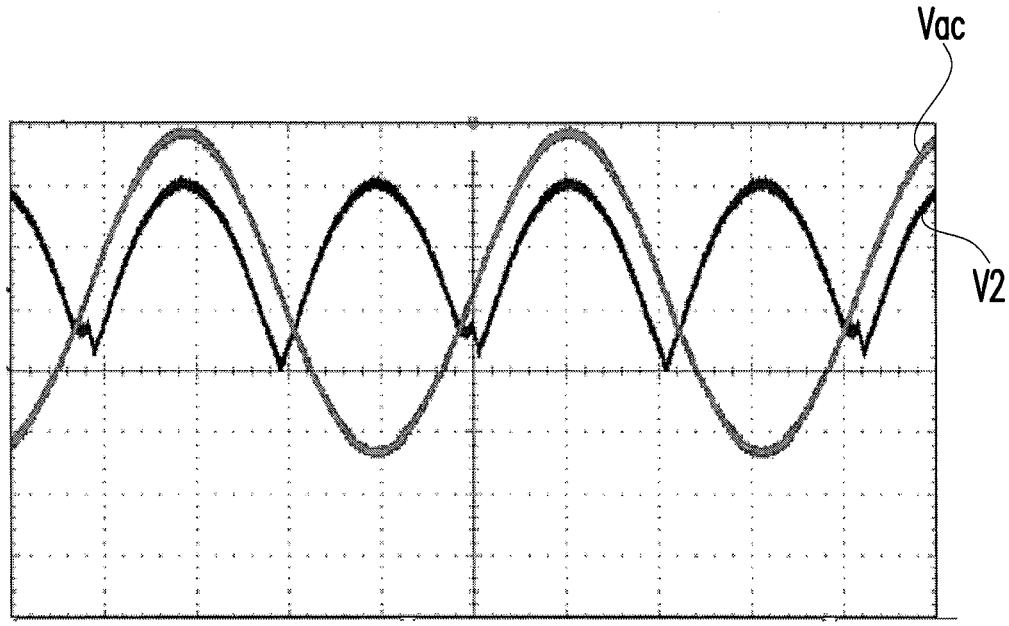
FIG. 5 is a waveform diagram of an AC signal Vac and a signal V2 of the driving circuit of LED of FIG. 3.

FIG. 4B is a schematic diagram illustrating a current path of the driving circuit 300 of LED of FIG. 3 when the AC power 310 provides a negative voltage $Vac^-$. As shown in FIG. 4A, when the AC power 310 provides the negative voltage $Vac^-$, a path P2 of a part of the current Iac2 is sequentially the second end E2, the resistor R4, the waveform sampler 340, the ground terminal, the diode D3 and the first end E1. When the current Iac2 flows through the resistor R2 of the waveform sampler 340, the signal V2 corresponding to the negative voltage $Vac^-$ is generated at the negative end EN of the comparator 356, and the signal V2 is provided to the comparator 356 for comparison, so as to turn on or turn off the power converter 330. Similarly, since the waveform sampler 340 is directly coupled to the AC power 310, the signal V2 to be captured is more close to the source (i.e. the negative voltage $Vac^-$), and the provided signal V2 can be varied along with the negative voltage $Vac^-$, so that the current waveform of the current Ics is more close to a voltage waveform of the negative voltage $Vac^-$, and finally a waveform of the current Iac2 is more closed to the waveform of the negative voltage $Vac^-$, so as to achieve a higher power factor. Compared to the conventional circuit of FIG. 1, since the comparator 107 of FIG. 1 receives the fixed reference voltage Vref, the current Isw of FIG. 1 cannot follow the waveform of the negative voltage $Vac^-$ to achieve a better power factor. In the present embodiment, since the waveform sampler 340 is directly coupled to the source, the provided signal V2 can be varied along with the negative voltage $Vac^-$, and the current waveform of the current Ics is more close to the waveform of the negative voltage $Vac^-$, so that the waveform of the current Iac2 is more close to the waveform of the negative voltage $Vac^-$, so as to achieve a better power factor. FIG. 5 is a waveform diagram of the AC signal Vac and the signal V2 of the driving circuit 300 of LED of FIG. 3. According to FIG. 5, in the present embodiment, since the signal V2 captured by the waveform sampler 340 is very close to the AC signal Vac provided by the AC power 310, the driving circuit 300 of LED can indeed provide a better power factor. It should be noticed that in the present embodiment, regardless of the positive voltage $Vac^+$ or the negative voltage $Vac^-$, the signals V2 captured by the waveform sampler 340 are all DC voltages and are, for example, positive. In other words, in the embodiment, before the signal V2 is captured, it is unnecessary to configure a rectifier for rectifying the AC signal Vac to obtain a DC signal V2 for comparison, so that a configuration space of the circuit is saved.

Second Embodiment

Figure 6:
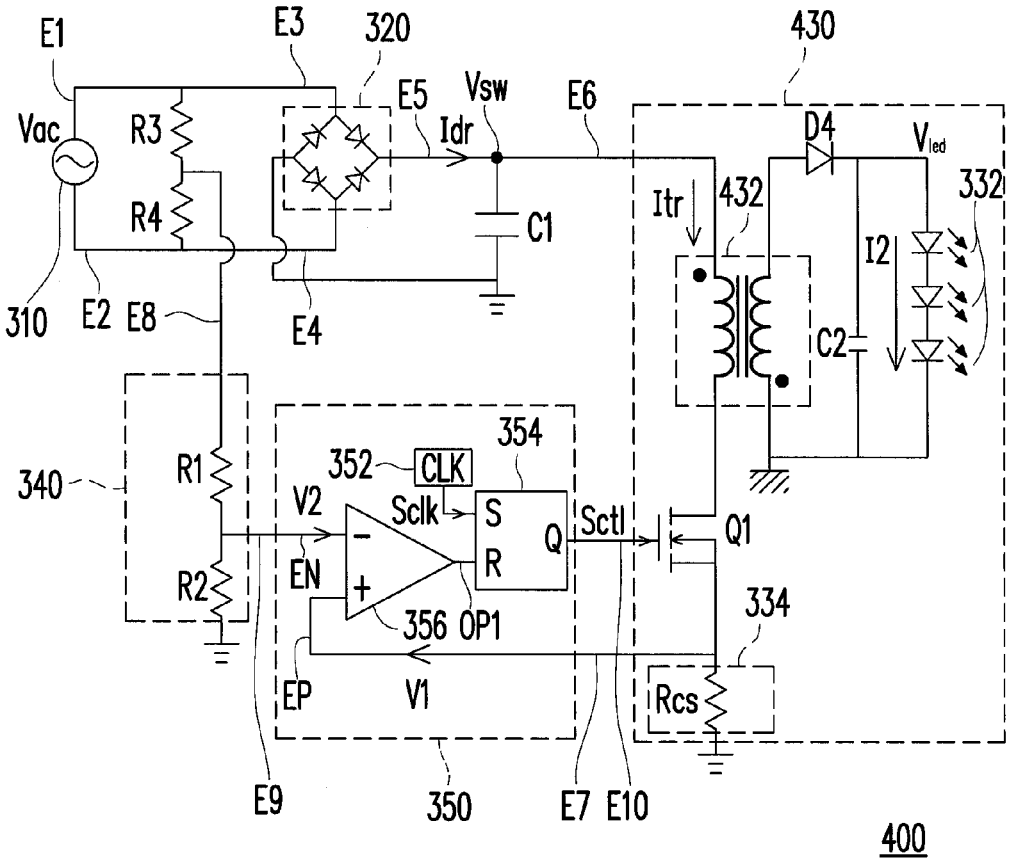
FIG. 6 is a schematic diagram of a driving circuit of LED according to the second embodiment of the invention.

FIG. 6 is a schematic diagram of a driving circuit of LED according to the second embodiment of the invention. The driving circuit 400 is similar to the driving circuit 300 of FIG. 3, and a main difference there between is that a power converter 430 of the present embodiment is a fly back converter. As shown in FIG. 6, the power converter 430 includes a transformer 432, where the switch Q1 and the current sensor 334 are located at a primary side of the transformer 432, and the LEDs 332, the capacitor C2 and the diode D4 are located at a secondary side of the transformer 432. In detail, the diode D4 is coupled to the capacitor C2 and the LEDs 332, and the capacitor C2 is coupled in parallel to the LEDs 332. The primary side of the transformer 432 provides a fixed power (Vsw*Itr), and transfers the fixed power (Vsw*Itr) to the secondary side to form a power ($V_{led}$*I2) the same to the power of the primary side, so as to provide a current I2 to the LEDs 332 to light the LEDs 332, where $V_{led}$ is a cross-voltage of the three LEDs 332. Moreover, when the switch Q1 is turned on, the diode D4 is inversely biased and is not conducted, and when the switch Q1 is turned off, the diode D4 is forward biased and is conducted. The related operation principles can refer to related descriptions of the first embodiment, and detailed descriptions thereof are not repeated.

Third Embodiment

Figure 7:
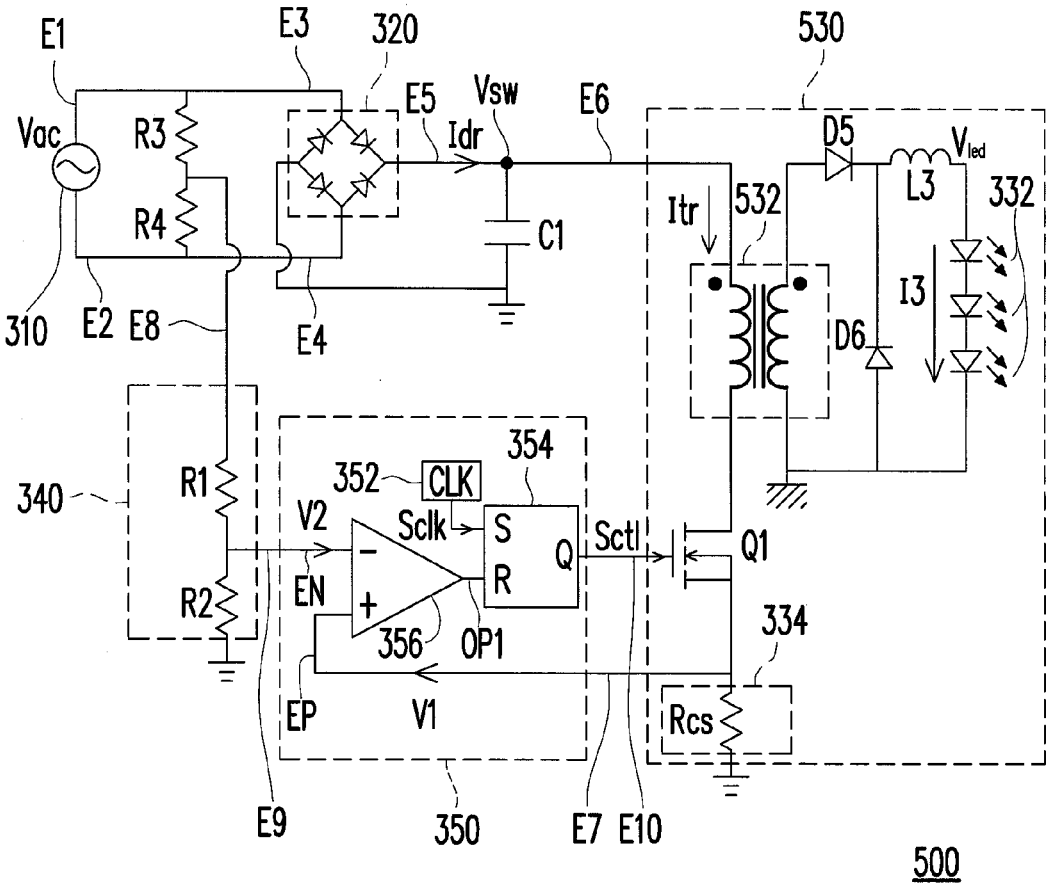
FIG. 7 is a schematic diagram of a driving circuit of LED according to the third embodiment of the invention.

FIG. 7 is a schematic diagram of a driving circuit of LED according to the third embodiment of the invention. The driving circuit 500 is similar to the driving circuit 400 of FIG. 6, and a main difference there between is that a power converter 530 of the present embodiment is a forward converter. As shown in FIG. 7, the power converter 530 includes a transformer 532, where the switch Q1 and the current sensor 334 are located at a primary side of the transformer 532, and the LEDs 332 and the diode D5-D6 are located at a secondary side of the transformer 532. As shown in FIG. 7, the diode D5 is coupled to the diode D6 and an inductor L3, the inductor L3 is coupled to the LEDs 332, and the diode D6, the inductor L3 and the LEDs 332 form a loop. The primary side of the transformer 532 provides a fixed power (Vsw*Itr), and transfers the fixed power (Vsw*Itr) to the secondary side to form a power ($V_{led}$*I3) the same to the power of the primary side, so as to provide a current I3 to the LEDs 332 to light the LEDs 332, where $V_{led}$ is a cross-voltage of the three LEDs 332. Moreover, when the switch Q1 is turned on, the diode D5 is forward biased and is conducted, and when the switch Q1 is turned off, the diode D5 is inversely biased and is not conducted. The related operation principles can refer to related descriptions of the first embodiment, and detailed descriptions thereof are not repeated.

In summary, in the invention, by directly coupling the waveform sampler to the AC power to capture a voltage-divided signal, the voltage-divided signal is very close to the AC signal and is less influenced by post-end load devices. In this way, the input current (for example, the current Iac1 or Iac2) can be more close to the AC signal, so as to provide a higher power factor. Moreover, since the circuit design is not complicated and a size of the capacitor is greatly reduced, a volume of the circuit structure can be reduced.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving circuit of a light emitting diode (LED), comprising:

an alternating current (AC) power, having a first end and a second end, and providing an AC signal through the first end and the second end;

a rectifier, having a third end, a fourth end and a fifth end, wherein the third end and the fourth end are respectively coupled to the first end and the second end, and the rectifier outputs a driving signal through the fifth end;

a power converter, having a sixth end coupled to the fifth end, and the power converter comprising an LED, and outputting a first signal positive correlated with a current passing through the LED through a seventh end;

a waveform sampler, having an eighth end and a ninth end, wherein the eighth end is coupled after the AC power and before the rectifier, and the waveform sampler outputs a second signal directly proportional to the AC signal through the ninth end; and a control circuit, having a tenth end, and coupled between the ninth end of the waveform sampler and the seventh end of the power converter, and outputting a control signal to the power converter through the tenth end.

2. The driving circuit of the LED as claimed in claim 1, wherein the waveform sampler comprises:

a first resistor, having one end coupled to the AC power, and another end coupled to the ninth end of the waveform sampler; and a second resistor, having one end coupled to the first resistor and the ninth end of the waveform sampler, and another end coupled to ground.

3. The driving circuit of the LED as claimed in claim 2, further comprising:

a third resistor, having one end coupled to the first end of the AC power, and another end coupled to the first resistor; and a fourth resistor, having one end coupled to the third resistor, and another end coupled to the second end of the AC power.

4. The driving circuit of the LED as claimed in claim 1, further comprising a capacitor coupled between the fifth end of the rectifier and ground.

5. The driving circuit of the LED as claimed in claim 1, wherein the power converter further comprises:

a switch, coupled to the LED; and a current sensor, coupled to the switch and ground, and outputting the first signal through the seventh end.

6. The driving circuit of the LED as claimed in claim 5, wherein the first signal is a voltage signal.

7. The driving circuit of the LED as claimed in claim 6, wherein the current sensor comprises a fifth resistor, and the fifth resistor is coupled to the LED in series.

8. The driving circuit of the LED as claimed in claim 5, wherein the power converter is a buck converter.

9. The driving circuit of the LED as claimed in claim 5, wherein the power converter is a fly back converter.

10. The driving circuit of the LED as claimed in claim 5, wherein the power converter is a forward converter.

11. The driving circuit of the LED as claimed in claim 1, wherein the control circuit comprises:

a clock generator;

a SR flip-flop, coupled between the clock generator and the power converter, having a setting terminal and a reset terminal, and receiving a clock signal through the setting terminal; and a comparator, having a positive end, a negative end and an output end, wherein the positive end is coupled to the seventh end of the power converter, the negative end is coupled to the ninth end of the waveform sampler, and the output end is coupled to the reset terminal of the SR flip-flop.

12. The driving circuit of the LED as claimed in claim 1, wherein the rectifier is a bridge rectifier.

* * * * *